United States Patent [19]

Bierlich

[11] 4,164,830

[45] Aug. 21, 1979

[54] DOUBLE-GLAZED DOORS OR WINDOWS AND FRAME ASSEMBLIES THEREFOR

[76] Inventor: Johannes H. Bierlich, Øresundshøj 15, Charlottenlund, Denmark

[21] Appl. No.: 861,494

[22] Filed: Dec. 16, 1977

[51] Int. Cl.[2] ..... E04C 2/38

[52] U.S. Cl. ..... 52/398; 52/461; 52/476; 52/764; 52/730; 52/790

[58] Field of Search ..... 52/397–403, 52/502, 730–732, 476, 212, 213, 461–463, 309.1, 764, 498; 49/DIG. 1, DIG. 2, 501

[56] References Cited

U.S. PATENT DOCUMENTS

| | | | |
|---|---|---|---|
| 2,575,655 | 11/1951 | Clerk | 52/398 |
| 3,101,817 | 8/1963 | Radek | 52/732 |
| 3,147,518 | 9/1964 | Horgan | 52/476 |
| 3,232,395 | 2/1966 | LaBarge | 52/461 |
| 3,289,377 | 12/1966 | Hetman | 52/731 |
| 3,303,626 | 2/1967 | Brigham | 52/309.1 |
| 3,455,080 | 7/1969 | Meadows | 52/476 |
| 3,593,475 | 7/1971 | LaGue | 52/461 |
| 3,798,869 | 3/1974 | Nipp | 49/DIG. 1 |

FOREIGN PATENT DOCUMENTS

| | | | |
|---|---|---|---|
| 650288 | 3/1964 | Belgium | 52/461 |
| 417021 | 1/1967 | Switzerland | 52/212 |
| 949997 | 2/1964 | United Kingdom | 52/398 |

*Primary Examiner*—James L. Ridgill, Jr.
*Attorney, Agent, or Firm*—Brisebois & Kruger

[57] ABSTRACT

The invention relates to a frame assembly for making double-glazed doors or windows comprising a metal extrusion having a cross-section, preferably an H-section, providing an open channel having oppositely facing abutments along the internal surfaces of the free edges of the channel side walls, a facing strip extruded of a substantially rigid plastics material of a desired color having a profiled rib along its rear face which fits between and interlocks with the abutments to hold the facing strip bridging the channel side walls. The metal extrusion provides the necessary rigidity to a frame as well as a fixing for hinges or hardware, while the inner and/or outer facing strips provide a thermal break between the inner and outer sides of the frame as well as a substantially permanent and weatherproof decorative finish to the frame.

8 Claims, 7 Drawing Figures

DOUBLE-GLAZED DOORS OR WINDOWS AND FRAME ASSEMBLIES THEREFOR

FIELD OF THE INVENTION

The present invention relates to double-glazed doors and windows, and more particularly to frame assemblies therefor which incorporate thermally insulating components to impede heat transference between the inner and outer surfaces of the frame assembly. In this specification "inner" and "inwardly" when referring to a part of a door or window or its frame, means a part which is located or faces towards the inside of the building in which the door or window is or is adapted to be fitted, and "outer" and "outwardly" means a part of the door or window or its frame which is located or faces towards the exterior of the building.

Various extruded sections of plastics materials have been produced for use in making thermally-insulating frames for double-glazed windows and doors in lieu of frames made from assemblies of inner and outer metal portions, e.g. extruded aluminium sections, with a thermal break between the inner and outer metal portions of the frame.

Frames made from plastics extrusions have the advantage that they can be made in a wide variety of colours without having to be protected from the atmosphere by painting, anodizing or other protective treatments. On the other hand, plastics materials are more easily flexed or distorted than metal, which necessitates rather heavy and/or complex plastics sections which, even so, require reinforcement by metal or wood, not only for increasing rigidity and strength but also for the secure attachment of hinges and other hardware.

SUMMARY OF THE INVENTION

The present invention has for an object to provide a frame assembly for making double-glazed doors or windows, and a method of making such assemblies and frames for doors or windows, which enables the advantages of plastics frames to be combined with the advantages of metal frames in a simple manner.

From one aspect the invention consists in a frame assembly for making double-glazed windows or doors comprising an elongate metal member having a cross-section including at least one open channel facing inwardly or outwardly and having oppositely facing abutments along the inside surfaces of the opposing channel side walls adjacent the free edges thereof, and a facing strip extruded from a substantially rigid plastics or other thermal insulating material with a cross-section including a rib extending therealong which is profiled in cross-section to fit between and interlock with the opposing pair of abutments of the channel to hold the facing strip bridging the free edges of the channel side walls with a marginal edge zone of the strip projecting laterally beyond a side wall of the channel.

The invention also consists in a frame assembly for making double-glazed windows or doors comprising an elongate metal member having a cross-section comprising two open channels respectively facing in opposite directions, inwardly and outwardly, each channel having oppositely facing abutments along the inside surfaces of the opposing channel side walls adjacent the free edges thereof, and inner and outer facing strips each extruded from a substantially rigid plastics or other thermal insulating material with a cross-section including a rib extending therealong which is profiled in cross-section to fit between and interlock with opposing pairs of abutments of a channel to hold the associated facing strip bridging the free edges of the channel side walls.

The cross-section of a facing strip may include a marginal edge portion which projects laterally of the adjacent channel side wall when its rib is secured between the channel walls. Or edge portions along opposite edges of a strip may project beyond both side walls respectively when the strip is secured to the core member.

The elongate metal member is preferably extruded, conveniently of aluminium or an aluminium alloy. The metal may be of a springy nature and the channel side walls sufficiently deep to enable a facing strip to be assembled to a metal member by pressing its profiled rib into the open end of the channel to spring the channel walls and the abutments apart and over the profiled peak of the rib until the flexed channel walls cause the abutments to snap into and interlock with grooves along the profiled rib and thereby secure the plastics facing strip and the metal member together. BRIEF DESCRIPTION OF THE DRAWINGS FIG. 1 shows a section through parts of the frame assemblies of a window sash and a window frame according to one embodiment of the invention, FIG. 2 is a fragmentary perspective view showing one mode of joining frame members at the corners of a rectangular window sash, and FIGS. 3–7 show modified embodiments of the invention.

DETAILED DESCRIPTION OF THE INVENTION

Figure 1:
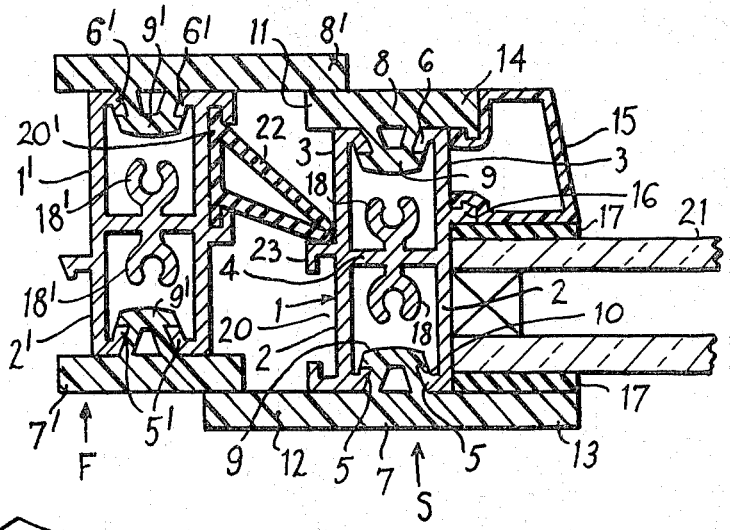

Referring to FIG. 1, the frame members of a window sash is shown as comprising a metal member 1 extruded of a springy grade of an aluminium alloy with a generally H-shaped cross-section defining two oppositely facing, inwardly and outwardly, channels defined by channel side walls 2,3 respectively and a common end wall 4. Along the inside surfaces of the channel side walls 2 and 3, at or adjacent their respective free edges, are oppositely facing abutments 5,6 respectively, shown in the embodiment illustrated as having a hook shape in cross-section.

Along the free edges of the inwardly and outwardly facing open channels are secured inner and outer facing strips of plastics material 7,8 respectively. Each strip is extruded from a substantially rigid plastics material, such as a rigid or semi-rigid grade of polyvinyl chloride or other plastics material, neoprene or rubber, with a cross-section including a rib portion 9 which is snap-fitted and gripped between the opposing side walls of a channel. To this end the rib 9 is profiled in cross-section with oppositely facing recesses corresponding to the shape of the abutments 5,6 and having shoulders 10 adapted to engage behind and interlock with the hooked ends of the abutments. A facing strip is assembled to the metal member 1 by positioning its rib along the edges of the open channel and pressing the parts together. This causes the metal side walls of the channel to flex apart against the springiness of the metal until the abutments snap back into the recesses in the profiled rib and engage between the shoulders 10 and the back of the facing strip, thus firmly gripping the rib 9 and securing the associated strip assembled to the metal member and bridging the side walls of the channel. The channel side walls are made of such thickness and depth as to provide the desired springiness. To compensate for the channel side walls possibly not returning fully to their original positions after being sprung apart the metal member 1 may be extruded with the side walls of a channel inclined slightly towards one another. The springiness of the metal may be improved by known heat treatment.

The facing strips may be extruded with any desired cross-section to provide a desired facing, and optionally a desired function, at the inner side and outer side of the frame member. For example, a strip may include an edge portion, as shown at 11, 12, 13, and 14, which projects laterally of the adjacent channel side wall.

Figure 2:
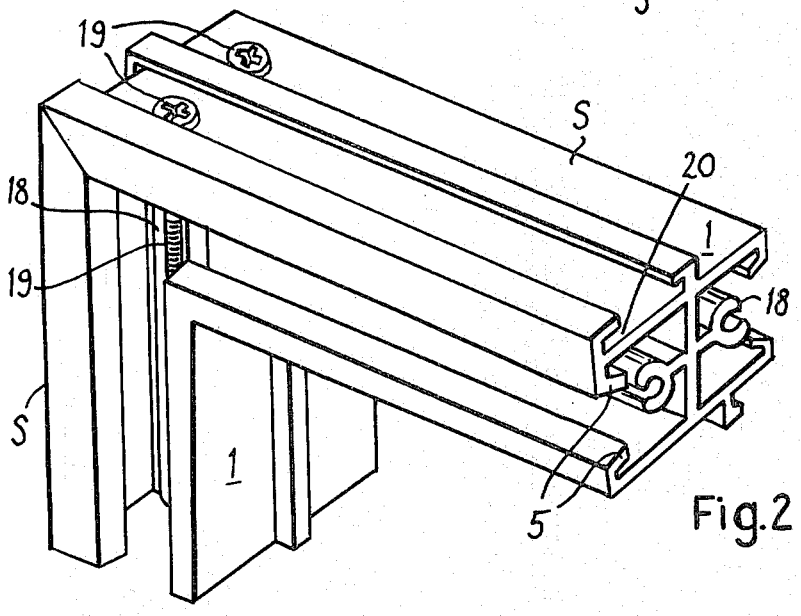

The metal member 1 is also extruded, in each channel, with part cylindrical portions 18 which serve for joining adjacent frame members S together at the corners of a rectangular window sash. As illustrated in FIG. 2, in which the facing strips are omitted for clarity, the ends of adjacent frame members S are mitred and secured together by two self-tapping screws 19 inserted through holes in one frame member and screwed into the passage of the corresponding portion 18 of the adjacent member, respectively. In assembling a rectangular sash the facing strips are cut slightly longer than the metal members and the ends of adjacent facing strips are joined together by heat-welding or in any other convenient way before the screws 19 are tightened. The subsequent tightening of the screws 19 causes slight compression of the facing strips, thereby ensuring tight corner joints.

The metal member 1 is shown as being extruded with an undercut recess 20 which can be used, for example, to accommodate slide members (not shown) for actuating locking bolts on the window sash.

The double-glazing, which may be a sealed double-glazing panel 21, is fitted between the edge portion 13 of the strip 7 and a bead 15 which may be made of a substantially rigid plastics material and is snapped into place between the back of the edge portion 14 of the strip 8 and the rib 16 on the metal member 1. Sealing members 17 may be interposed between the panel 21 and the portion 13 and/or the bead 15. If desired, the sealing members may be constituted by flexible lips integral with the bead and/or the portion 13.

The frame assembly described possesses the advantages both of plastics materials and aluminium. The snap-together assembly reduces strains between the metal and plastics material due to the different coefficients of expansion. The metal member 1 provides strength and rigidity to the frame and for the fixing of hardware. As the metal member has minimal flanges parallel to the wall 4 it can also be bent relatively easily to produce window sashes with rounded corners.

The operation of forcing the profiled ribs 9 between the channel side walls may be effected progressively, for example by feeding the metal member and the facing strips, one at a time or both together, between pressing rolls.

A window sash constructed from frame members S as shown in FIG. 1 is intended to open inwardly of the surrounding window frame. The window frame may be made of timber or it may be constructed according to the invention, for example as shown at F in FIG. 1. The parts of the frame F which correspond with parts of the sash S are given the same references with a prime. The undercut recess 20' on the metal member 1' of the frame F receives a sealing strip 22 against which the rib 23 on the metal member 1 of the sash S engages when the sash is closed.

Figure 3:
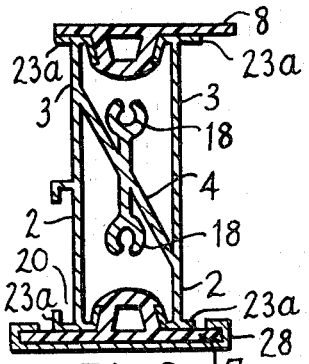

In order to reduce the overall depth of the metal member 1, the latter may be extruded with an inclined wall 4 as shown in FIG. 3 whereby, despite the reduction in overall depth of the H-section member, each channel has one side wall sufficiently deep to provide adequate flexibility to permit the pressing in of the rib 9 of a strip. The effective length of the other side wall of a channel is increased by reason of the inclination of the wall 4.

Figure 4:
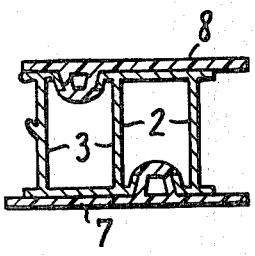
Figure 5:
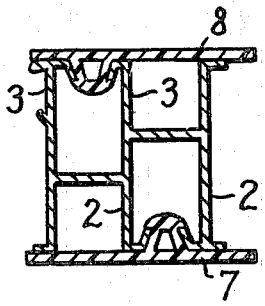

The overall depth of the member 1 may alternatively be reduced by extruding the member with its two oppositely facing channels in side-by-side or partially overlapping arrangement as shown in FIGS. 4 and 5 respectively.

The metal member 1 may, as shown in FIG. 3, be extruded with flanges **23*a* along the outsides of the free edges of the channel side walls (one of these flanges also constitutes part of the recess 20) to form water stops to impede ingress of water between the facing strips and the metal member 1**.

If desired, a plastics strip may be faced with metal; for example as shown in FIG. 3 a metal facing 28 of aluminium, stainless steel or other cladding may be rolled, slid or snapped on to the strip 7. A facing of aluminium may be anodised.

According to a modification, the elongate metal member has only a single open channel, instead of two oppositely facing channels as in the embodiments illustrated in FIGS. 1 to 5, and a single facing strip interlocked with the abutments along the edges of the side walls of the single channel. The modification provides a cheaper and simpler construction which enables the overall depth of the frame assembly to be kept to a minimum consistent with a desired strength. Two embodiments of this modification are illustrated in FIGS. 6 and 7 in which components and parts which are the same as or equivalent to components or parts of the frame assembly described with reference to FIG. 1 are referenced with the same reference numerals.

Figure 6:
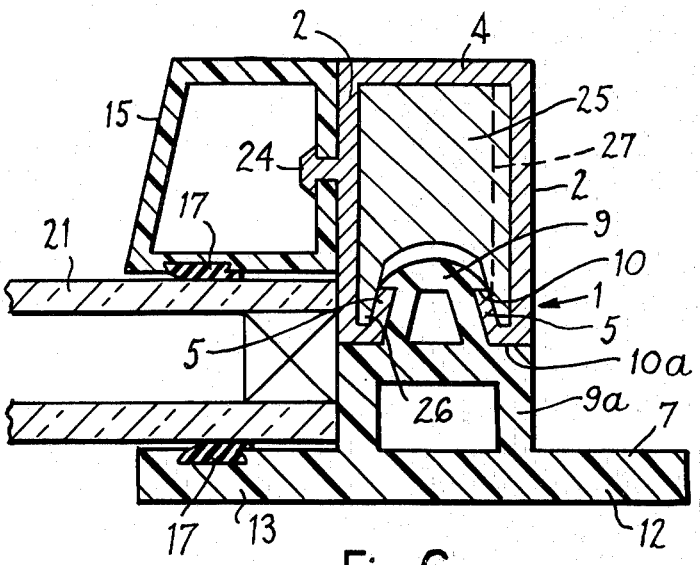
Figure 7:
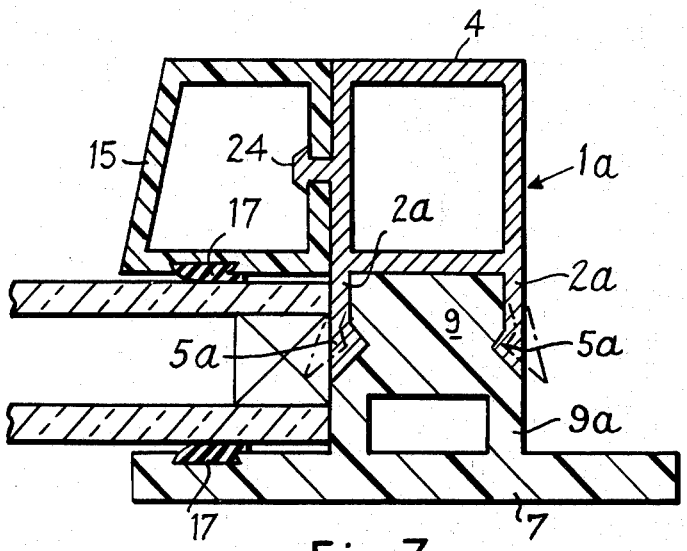

Referring to FIG. 6, the frame member of a window sash is shown as comprising a member 1 extruded of a springy grade of an aluminium alloy with a cross-section including an inwardly facing channel defined by channel side walls 2 and an end wall 4. Along the inside surfaces of the channel side walls 2, at or adjacent their respective free edges, are oppositely facing abutments 5, shown in the embodiment illustrated as having a hook shape in cross-section.

Along the free edges of the channel is secured a facing strip 7 of plastics material with a cross-section including a rib portion 9 which is snap-fitted and gripped between the opposing side walls of the channel. To this end the rib 9 is profiled in cross-section with oppositely facing recesses corresponding to the shape of the abutments 5 and having shoulders 10 adapted to engage behind and interlock with the abutments. The rib also has a spacer portion **9*a* of a width corresponding to the width across the channel side walls 2. The spacer portion provides the lower shoulders 10*a* of the recesses and also provides an increased depth of plastics material between the portions 12,13 of the facing strip and the edges of the metal channel side walls to provide improved thermal insulation between the inner and outer sides of the frame assembly. The facing strip is assembled to the metal member 1 by positioning its rib along the open end of the channel and pressing the parts together as described above, the abutments snapping back into the recesses in the profiled rib and engaging between the shoulders 10,10***a*.

The double glazing, which may be a sealed double-glazing panel 21, is fitted between the edge portion 13 of the strip 7 and a bead 15 which may be made of a substantially rigid plastics material and secured in position by being snapped over a headed rib 24 along the member 1. If desired the bead 15 may be provided with a projecting flange (not shown) to cover the outwardly facing surface of the end wall 4.

The bead 15 may alternatively be made of metal, e.g. an aluminium extrusion, which may be secured to the extrusion 1 by any convenient clipping or other securing arrangement. Any exposed surfaces of the extrusion 1 and bead 15 may be anodised.

The edge portion 13 of the strip 7 and the bead 15 are shown fitted with sealing members 17 including a flexible lip for sealing against the glazing panel.

For forming rectangular frames, the frame members may be mitred at the corners and joined by corner cleats 25 having two arms at right angles which respectively extend in to the spaces defined by the channels of two frame members to be joined together and secured therein in any convenient manner. Only one of the arms of the cleat adjacent the mitred corner of a frame member is indicated in the drawing, but both arms may have the same cross-section as shown which substantially fills the space within a channel not occupied by a rib 9, and include lip portions 26 which fit into the recesses behind the hook-shaped abutments to hold the channel walls against movement apart in the finished frame. Each arm of the cleat is provided with a transversely extending groove, the bottom of which is indicated by a dotted line 27, and is secured in position by indenting the channel wall to produce a corresponding rib on the inside surface of the channel wall which bears against the side of the groove 27 remote from the corner. Thus adjacent frame members of the sash can be firmly assembled without the use of screws or other separate fixing means.

According to a further modification, instead of employing the resilience of the channel walls for securing the profiled rib of the facing strip thereto, the profiled rib is secured in the channel by pressing or rolling the channel side walls together to force the free edges thereof or abutments therealong into the recesses along the profiled rib. For example, as shown in FIG. 2, the metal member 1*a* is extruded, e.g. of aluminium, with a relatively shallow channel of which the side walls 2*a* are, as the section is extruded, splayed apart (dotted line position) so that the profiled rib 9 of the plastics strip can be inserted therebetween whereafter, by a rolling operation, the side walls 2*a* are forced together to urge the abutments 5*a* therealong into the recesses along the rib 9.

I claim:

1. A door or window comprising at least two panes of glass secured, with an air gap therebetween, in a generally rectangular frame constructed of a plurality of frame members which are joined together at the corners of the frame and are each assembled from metal and thermally insulating components to impede heat transference through the thickness of the frame member between its inner and outer surfaces, characterised in that each frame member assembly comprises a metal extrusion having a cross-section comprising spaced apart walls extending in the direction substantially perpendicular to the panes of glass for the major part of the thickness of the frame member, and defining at least one open channel having two integral side walls and an end wall and having oppositely facing abutments along the inside surfaces of the opposing channel side walls adjacent the free edges thereof, and a facing strip extruded from a substantially rigid thermal-insulating material with a cross-section including front and rear surfaces and an integral substantially rigid rib which extends along said rear surface and which is profiled with oppositely facing recesses which fit between and interlock with the opposing pair of abutments of the channel to hold the facing strip bridging the free edges of the channel side walls with a marginal edge zone of the strip projecting laterally beyond a side wall of the channel, said recesses being of a width such that the free edges of the channel side walls abut against and directly support those portions of the rear surface of the facing strip which are adjacent opposite sides of the rib.

2. A door or window as claimed in claim 1, wherein the rib of a facing strip includes an integral spacer portion of a width corresponding to the width across the channel side walls to define shoulders of the recesses in the rib portions which abut the free edges of the channel side walls when said rib portion is fitted between and interlocked with the opposing pair of abutments of the channel side walls, said spacer portion providing a zone of thermally insulating material between the free edges of the channel side walls and the rear surface of a marginal edge zone of the facing strip.

3. A door or window as claimed in claim 1, characterised in that said spaced apart walls of a metal extrusion define two such open channels respectively facing in opposite directions, each channel having a pair of said oppositely facing abutments, and two said facing strips having their respective profiled ribs fitted between and interlocked with the respective pairs of abutments of the two channels.

4. A door or window as claimed in claim 3, wherein the metal member is extruded of an aluminium alloy having a springy nature, the end wall divides the oppositely facing channels and is inclined obliquely to the side walls of the channels and at least one of the side walls of each channel is sufficiently deep to enable a facing strip to be assembled thereto by pressing its profiled rib between the free edges of the channel side walls.

5. A door or window as claimed in claim 1, wherein the metal member is extruded of an aluminium alloy having a springy nature and the channel side walls are sufficiently deep to enable a facing strip to be assembled thereto by pressing its profiled rib between the free edges of the channel side walls.

6. A door or window as claimed in claim 5, wherein the extrusion also comprises part-cylindrical portions projecting into a channel which serve for joining adjacent frame member assemblies together at the corners of a rectangular frame.

7. A method of making a door or window as claimed in claim 1, which consists in mitreing the ends of said frame member assemblies such that the mitred ends of the facing strips project beyond the mitred ends of the metal extrusions in the direction normal to the plane of the respective mitre, joining the mitred ends of adjacent facing strips together, and then closing together and securing together the adjacent mitred ends of the adjacent metal extrusions, thereby to compress the facing strips along their length.

8. A method as claimed in 7, which consists in joining the mitred ends of adjacent facing strips together by heat-welding.

* * * * *